US006460301B1

(12) United States Patent
McKee

(10) Patent No.: US 6,460,301 B1
(45) Date of Patent: Oct. 8, 2002

(54) INSULATED GLASS FIBER REINFORCED CONCRETE/STEEL WALL SECTION AND METHOD FOR PRODUCING THE WALL SECTION

(76) Inventor: James E. McKee, 7151 Envoy Court, Dallas, TX (US) 75356

( * ) Notice: Subject to any disclaimer, the term of this patent is extended or adjusted under 35 U.S.C. 154(b) by 10 days.

(21) Appl. No.: 09/621,997

(22) Filed: Jul. 21, 2000

(51) Int. Cl.[7] ..... E04H 1/00
(52) U.S. Cl. ..... 52/235; 52/741.3; 52/404.1
(58) Field of Search ..... 52/481.1, 404.1, 52/404.2, 404.5, 405.1, 405.3, 506.01, 506.05, 508, 509, 742.14, 741.3, 745.19, 235

(56) References Cited

U.S. PATENT DOCUMENTS

| | | | | | |
|---|---|---|---|---|---|
| 4,185,437 | A | * | 1/1980 | Robinson | 52/601 |
| 4,404,158 | A | * | 9/1983 | Robinson | 264/263 |
| 4,453,359 | A | * | 6/1984 | Robinson | 52/389 |
| 4,531,338 | A | * | 7/1985 | Donatt | 52/235 |
| 4,554,124 | A | * | 11/1985 | Sudrabin | 264/263 |
| 5,033,248 | A | * | 7/1991 | Phillips | 52/743 |
| 5,055,252 | A | * | 10/1991 | Zimmerman | 52/309.12 |
| 5,526,629 | A | * | 6/1996 | Cavaness | 52/745.19 |
| 5,758,463 | A | * | 6/1998 | Mancini | 52/309.12 |

OTHER PUBLICATIONS

"Glassfibre Reinforced Concrete Practical Design and Structural Analysis" Fachvereinigung Faserbeton e.V.–Dusseldorf: Beton–verl., 1995 (Translation by rosemarie Lorenz, Berlin).

"Recomended Practice for Galss fiber Reinforced concrete Panels, 3rd Edition," MNL–128–93 Copyright 1993 Precast/Prestressed Concrete Institute.

* cited by examiner

*Primary Examiner*—Beth A. Stephan
(74) *Attorney, Agent, or Firm*—F. Lindsey Scott

(57) ABSTRACT

An insulated glass fiber reinforced concrete/steel wall section containing at least two steel wall studs and two end plates, the end plates having their ends joined to ends of the steel wall studs to form a wall section frame; a glass fiber reinforced concrete panel having a front side facing away from the wall studs and a back side facing toward the wall studs and having a plurality of bonding pads on its back side; a plurality of straps having a first and a second end, the first ends being insulated and positioned in the bonding pads and the second ends being connected to the wall studs; and, insulation positioned between the back side of the glass fiber reinforced panel and the steel wall studs. In one variation, no insulation is positioned between the back side of the glass fiber reinforced concrete panels and the steel wall studs. A method for fabricating the wall sections is disclosed.

33 Claims, 5 Drawing Sheets

INSULATED GLASS FIBER REINFORCED CONCRETE/STEEL WALL SECTION AND METHOD FOR PRODUCING THE WALL SECTION

FIELD OF THE INVENTION

This invention relates to an insulated glass fiber reinforced concrete/steel wall section and a method for economically and efficiently fabricating the wall sections.

BACKGROUND OF THE INVENTION

The manufacture of standard glass fiber reinforced cement (GFRC)/steel stud wall sections has been standard practice for several years. The industry has generated an enormous amount of data on both their structural durability and their utility for application to commercial buildings. They have not been widely used in the residential market because of inherent design problems. The primary reasons are the cost of manufacture inherent in a predominantly skilled labor intensive, low production system for producing the wall sections and the fact that the use of currently available GFRC panels is limited to architecturally decorative applications in the residential market since the wall sections have poor insulating value.

Such wall sections have many advantages. They are rot proof, vermin proof, termite proof, carpenter ant proof, warp proof, split proof, creep proof, creak proof, crack proof, non-toxic and maybe engineered to the highest seismic ratings. Further, these wall sections do not add fuel to a fire. Such GFRC panels and methods of fabricating such panels have been described in some detail in *GFRC Recommended Practice For Glass Fiber Reinforced Concrete Panels,* Third Edition, published by Pre-cast/Pre-stressed Concrete Institute, 1993. This publication describes current practices for use in the production of GFRC panels and their use in the fabrication of glass fiber reinforced cement/steel stud wall sections.

As described in the above publication, these wall sections have the advantages discussed above. However, they are also subject to the disadvantages that they have very poor insulating properties and that the steel wall studs tend to "sweat" since they become colder than the inside environment of most dwellings as a result of the high conductivity of the glass fiber reinforced concrete and the steel which are in direct thermal contact via the rods which fasten the glass fiber reinforced concrete panels to the steel wall studs. Wall sections of this type have been fabricated by producing the glass fiber reinforced concrete panels and thereafter positioning the steel wall section frame in position relative to the glass fiber reinforced concrete panels by the use of thermally conductive metal fasteners. The materials used as fasteners are generally steel rods having a diameter from about ⅜ to about ½ inch and are suitable for welding to the steel wall studs at one end with the other end of the rod, which is desirably bent to be generally parallel to a back surface of the concrete panel, being positioned at the desired location relative to the panel and then fastened in position by positioning a bonding pad of the glass fiber reinforced concrete over the end of the rod near the panel to retain the end of the rod in position relative to the back of the panel. The wall studs must be of a thickness sufficient for welding to the rods. This technique has been effective to fasten the concrete panel and the steel wall stud frame together, but it has provided a path for conduction of heat from the concrete panel to the wall studs. Since both of these materials are conductive, these wall sections offer very little insulating value. As a result, the steel wall studs tend to sweat. Insulation can be placed inside the steel wall studs but the presence of such insulation inhibits the installation of electrical lines, plumbing lines and the like between the studs and does little to inhibit the conduction of heat when conductive metal rods are in direct contact with both the steel wall studs and the concrete panel. A direct conductive heat path to the outside of the panel is provided.

It is desirable to achieve the advantages available from steel wall stud frames in conjunction with glass fiber reinforced concrete panels to form wall sections. A continuing search has been directed to the development of an improved method for fabricating such wall sections economically and efficiently and to the development of a method, which will provide such wall sections having a higher insulation value.

SUMMARY OF THE INVENTION

According to the present invention it has been found that desirable heat transfer characteristics and desirable wall sections of glass fiber reinforced concrete and steel wall studs are achieved with an insulated glass fiber reinforced concrete/steel wall section comprising:

a) a wall section frame comprising at least two steel wall studs and at least two steel end plates;

b) a glass fiber reinforced concrete panel having a front side facing away from the wall section frame and a back side facing toward the wall section frame and having a plurality of bonding pads on its back side;

c) a plurality of straps each having a first and a second end, the first ends being insulated and positioned in the bonding pads and the second ends being connected to the wall section frame; and, d) insulation positioned between the backside of the glass fiber reinforced panel and the wall section frame.

Such wall sections are efficiently fabricated by a method comprising:

a) producing a steel wall section frame by joining at least two steel wall studs to a top and a bottom plate to form the steel wall section frame;

b) positioning a restraining frame about the steel wall section frame;

c) positioning a formed insulation having a plurality of cavities, each having a bottom above the steel wall section and inside the restraining frame, d) positioning a plurality of straps each having a first end and a second end, the second end having insulation over the second end with the first ends being connected to the wall studs and with the second ends being positioned in the cavities with a selected space between the second ends and the bottoms of the cavities; and, e) filling the cavities and the frame above the formed insulation to a selected level with fluid glass fiber reinforced concrete to form a glass fiber reinforced panel.

The invention further comprises an insulated glass fiber reinforced concrete/steel wall section comprising a wall section frame comprising at least two steel wall studs and at least two steel end plates; a glass fiber reinforced concrete panel having a front side facing away from the wall studs and a back side facing the wall studs and having a plurality of bonding pads on its back side; and, a plurality of fasteners, the fasteners having a first and a second end, the first ends of the fasteners being insulated and positioned in the bonding pads and the second ends of the fasteners being connected to the wall section frame to support the panel in spaced relationship to the wall section frame with a space between the panel and the wall section frame.

The invention further comprises a method for fabricating an insulated glass fiber reinforced concrete/steel wall section by producing a steel wall section frame by joining at least two steel wall studs to a top and a bottom plate to form the steel wall section frame; connecting a plurality of fasteners, the fasteners having a first and a second end, the first ends being insulated, to support the steel wall section frame in spaced relationship to a glass fiber reinforced panel by positioning the first ends of the fasteners in supporting contact with the panel by positioning the first ends of the fasteners in bonding pads on a back surface of the panels and positioning the second ends of the fasteners in supporting contact with the wall frame.

The invention further comprises an insulated glass fiber reinforced panel for use in producing a glass reinforced concrete/steel wall section, the panel comprising a glass fiber reinforced panel having a first and a second side and a plurality of formed bonding pads on its first side; a formed insulation member having a first and a second side and a plurality of cavities containing the formed bonding pads on its first side; and a plurality of fasteners each having a first fastener end and a second fastener end, the first fastener end being insulated and positioned in a formed bonding pad with the fasteners extending from the formed bonding pads past or through the second side of the formed insulation.

A method for producing an insulated glass fiber reinforced panel for use in producing a glass reinforced concrete/steel wall section by positioning a frame about and extending above a formed insulation member having a plurality of cavities in its upper surface; positioning a plurality of fasteners, each of the fasteners having a first fastener end and a second insulated fastener end, so that an insulated fastener end is positioned in each cavity and filling the frame above the formed insulation member with fluid glass fiber reinforced concrete to form a glass fiber reinforced concrete panel above the formed insulation member.

Wall sections may be formed with the panels by attaching a steel wall section frame to the panel by attaching the second fastener ends to the steel wall section frame.

BRIEF DESCRIPTION OF PREFERRED EMBODIMENTS

In the description of the Figures, the same numbers will be used throughout to refer to the same or similar components.

Figure 1:
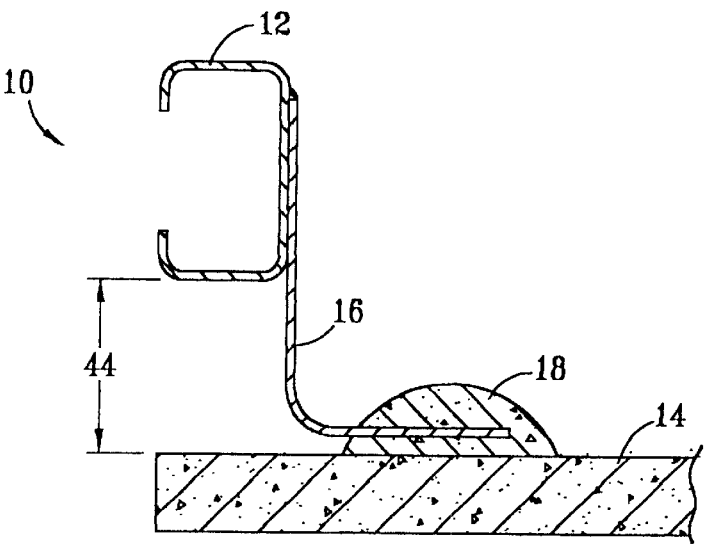
FIG. 1 PRIOR ART
FIG. 1 is a schematic diagram of a prior art connection between a steel wall stud and a glass fiber reinforced concrete panel.

Previously, a variety of arrangements have been used to produce wall sections having a glass fiber reinforced concrete panel exterior and a steel wall section frame comprising steel wall studs as a supporting structure. Typically the steel wall studs were joined to the glass fiber reinforced concrete panel by direct contact with a thermally conductive metal strap. The fastener may be a relatively flat strap, a rod or the like. In many instances, steel rods having a diameter from about 0.375 to about 0.500 inches were used since these rods are of a size readily welded to steel wall studs having a wall thickness of about 0.060 inches or more. While a variety of fasteners could be used with steel wall studs having a thickness of at least about 0.060 inches, such as welding, riveting, crimping, screws, bolts and the like to fasten the fasteners to the steel wall studs, the typical connection to the concrete panel has been the use of a bonding pad which has been applied to the rear of the concrete panel and an end of a rod. A representative connection of this type is shown in FIG. 1. A section of a glass fiber reinforced concrete/steel wall stud wall section 10 is shown having a steel wall stud 12 positioned in connection with a glass fiber reinforced concrete panel 14. Stud 12 has a fastener shown as a rod 16 connected to it by any suitable means, typically, welding. The rod is bent to have one of its ends extending roughly parallel to the back side of the concrete panel. A bonding pad 18 of concrete is then applied over the end of the strap parallel to the concrete panel and allowed to set. This type of connection has been used extensively in the past to connect glass fiber reinforced concrete panels to steel wall studs. This type of connection results in a thermally conductive path from the concrete panel to the wall stud. The studs are typically spaced a distance 44 of about 0.5 inch from the back of panel 14.

Figure 2:
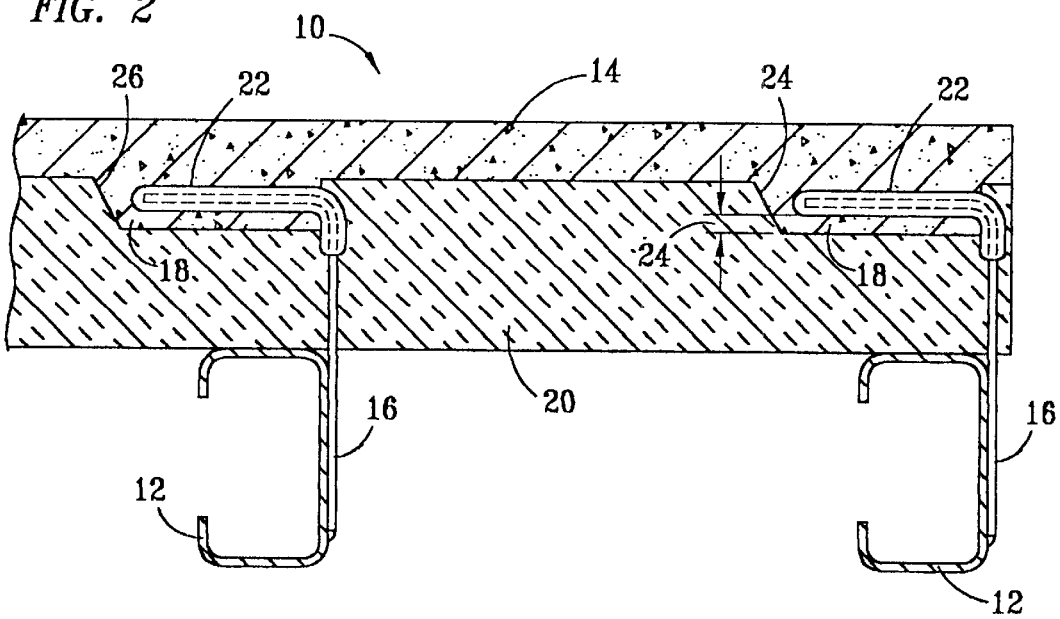
FIG. 2 is a cross-section of a portion of a wall section according to the present invention.

According to the present invention, these difficulties are overcome by a wall section construction as shown in FIG. 2. In FIG. 2, steel wall studs 12 are connected to fasteners, shown as straps 16 which are bent to extend generally orthogonally to the side walls of wall studs 12 and extend into bonding pads 18 on the back of concrete panel 14. Bonding pads 26 are formed to position a section of panel 14 around the ends of straps 16 positioned parallel to the back of panel 14. The ends of straps 16, which extend into the glass fiber reinforced concrete bonding pads are covered with a fastener insulating material 22. Typically the strap insulating material may be any suitable plastic such as polyethylene, polypropylene, nylon or any other suitably insulating plastic which is readily applied by a method such as dipping the ends of straps 16 into the insulating material or the like. The strap insulating material may be readily positioned on the ends of straps 16 by a variety of well-known methods. The ends of straps 16, which are covered with strap insulation 22, are positioned to extend into bonding pads 18 which are formed as a integral part of the glass fiber reinforced concrete panel 14. A preformed insulation 20 is positioned between the back of panel 14 and a side of steel wall studs 12 nearest panel 14. This insulation is desirably a preformed insulation, which is positioned to provide insulation between panel 14 and steel wall studs 12. The conductivity of straps 16 is greatly reduced as a result of the strap insulation 22 on straps 16 since these straps are no longer thermally conductive between the panel and the steel wall stud in the areas in which they contact panel 14. The bonding pads 26 are formed by cavities 26 positioned in preformed insulation 20 so that when the glass filled reinforced concrete is poured to form panel 14 it forms around the ends of straps 16 positioned in cavities 26.

The straps are desirably positioned in formed pads 18 to a depth 24 from about 0.250 to about 0.500 inches for a length of about 3 to about 5 inches.

In FIG. 2, straps are used instead of rods. Straps or other suitable configurations which provide a strap-like area for connection to wall studs 12 are preferred. Desirably the straps are from about 1 to about 1.5 inches wide and may have notched sides and the like, especially in the bonding pads. The straps may be of a thickness from about 0.020 to about 0.250 inches and preferably from about 0.020 to about 0.090 inches. The wall studs are preferably of a thickness from about 0.020 to about 0.090 inches and preferably from about 0.030 to about 0.050 inches. With straps and wall studs of these thicknesses, crimping can be used to join the wall studs and end plates (not shown in FIG. 2) and the straps. This is a much more efficient and economical method for joining these components. The use of welding, riveting, screws, bolts and the like is more labor intensive, requires heavier materials, and is more expensive and time consuming.

The strap insulation 22 can be provided by coating the insulation on the fastener or by positioning the insulation in the bonding pad as a receptacle for the fastener. For convenience, the insulation is referred to herein as coated on the fasteners.

Figure 3:
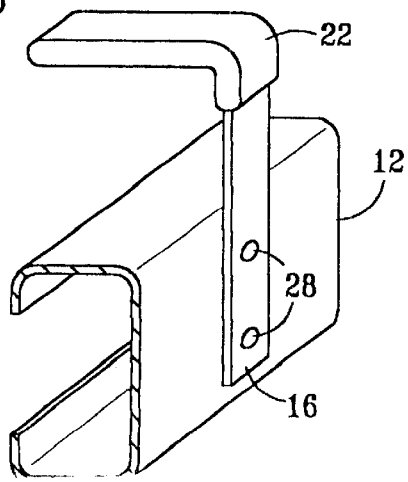
FIG. 3 is a schematic diagram of a wall stud, including a strap, according to the present invention.

In FIG. 3 a representative strap configuration including insulation 22 is shown fastened to a steel wall stud 12 by rivets 28. As noted previously, the fastening can be done with a variety of fasteners.

Figure 4:
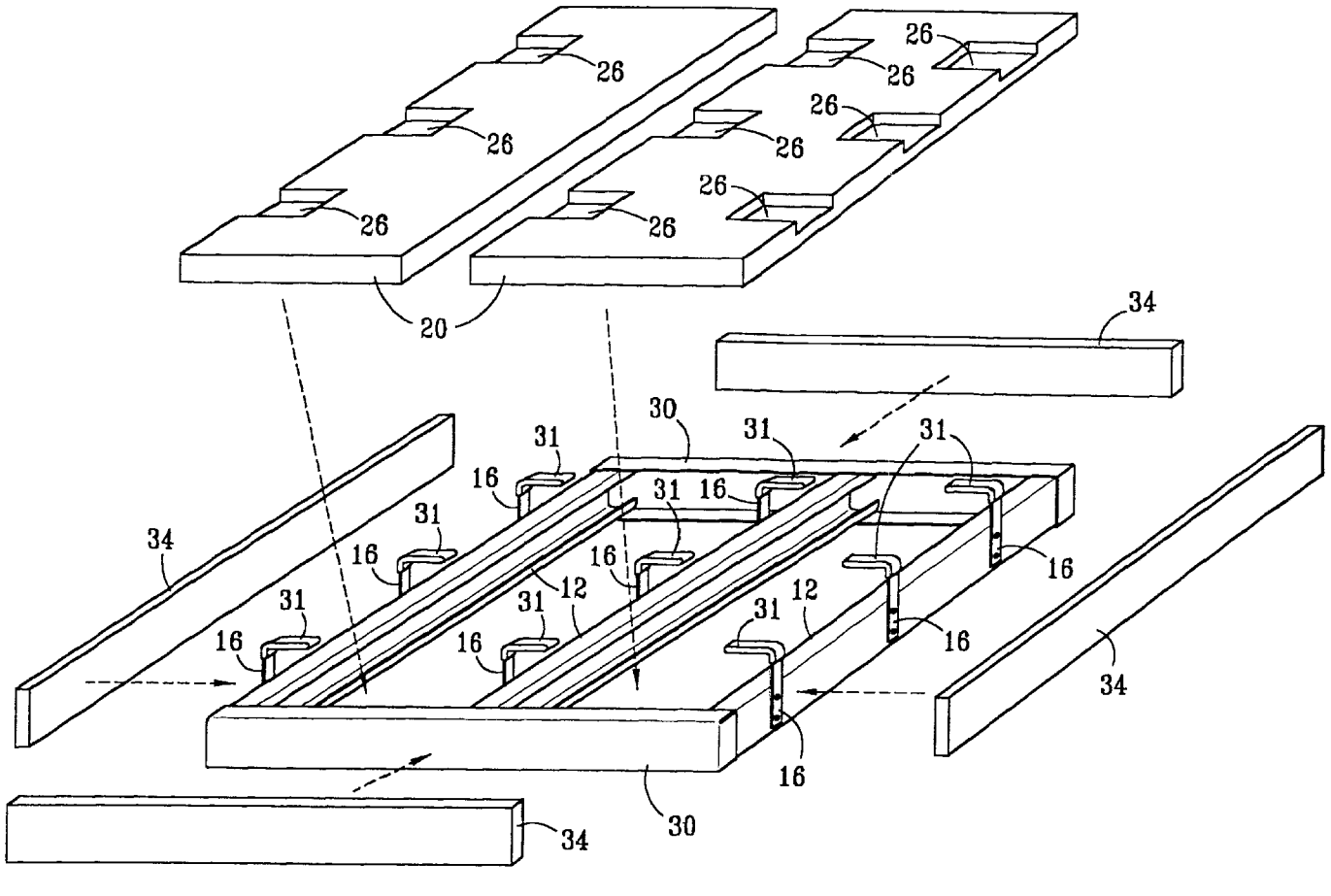
FIG. 4 is an isometric exploded view of an apparatus for assembling a wall section according to the present invention.

In FIG. 4 an apparatus for producing the wall sections of the present invention is shown. Steel wall studs 12 are shown with their ends joined to a pair of end plates 30. The resulting configuration forms a wall section frame for the wall section. A further steel wall stud 12 is positioned intermediate the two side steel wall studs. Additional studs may be used if desired and stud sections and end plate sections may be used to form doors, windows and the like. The spacing between studs may be any selected spacing. In FIG. 4 a plurality of straps 16 having insulation 22 on their ends above steel wall studs 12 are shown. A pre-formed insulation 20 is shown as preformed insulation having a plurality of cavities 26 being positioned therein. The preformed insulation may be any suitably rigid insulation known to the art, such as expandable polystyrene, rigid urethane insulation, rigid fiberglass insulation and the like. The preformed insulation is positioned above the steel wall studs 12 with the cavities 26 positioned beneath insulated strap ends 31. A frame 34 then is positioned around the outside of insulation 20 and the wall section frame and is then ready for pouring the glass fiber reinforced concrete into the frame above insulation 20. The cement flows around the insulated ends 31 in cavities 26 and forms bonding pads 18 around each of ends 31. Bonding pads 26 are formed as an integral part of the panel. The ends 31 as shown in FIG. 4 do not show insulation extending over all of the end of the straps extending into concrete for simplicity, but it is preferred that insulation 22 cover all of the portions of the straps which extend into the concrete.

Figure 5:
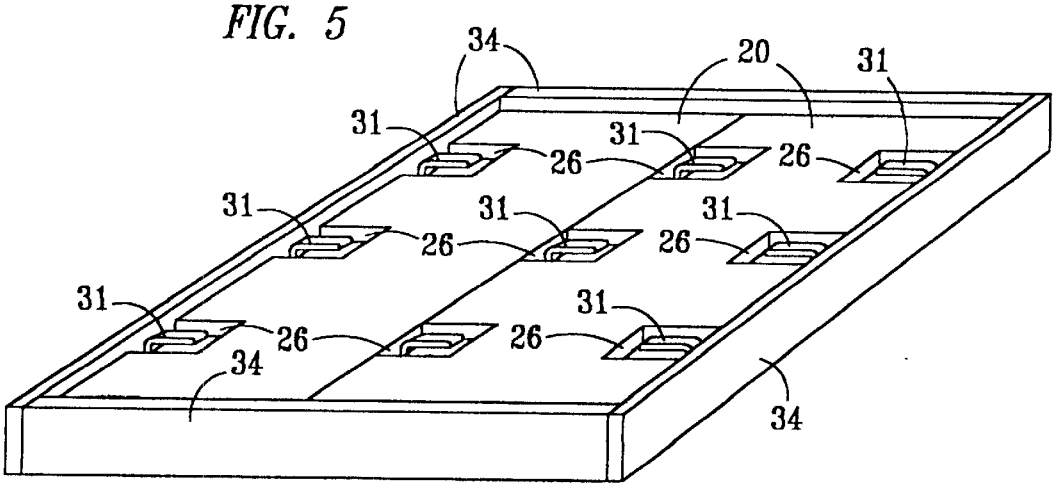
FIG. 5 shows an assembled form containing a wall stud frame and the formed insulation in place.
Figure 6:
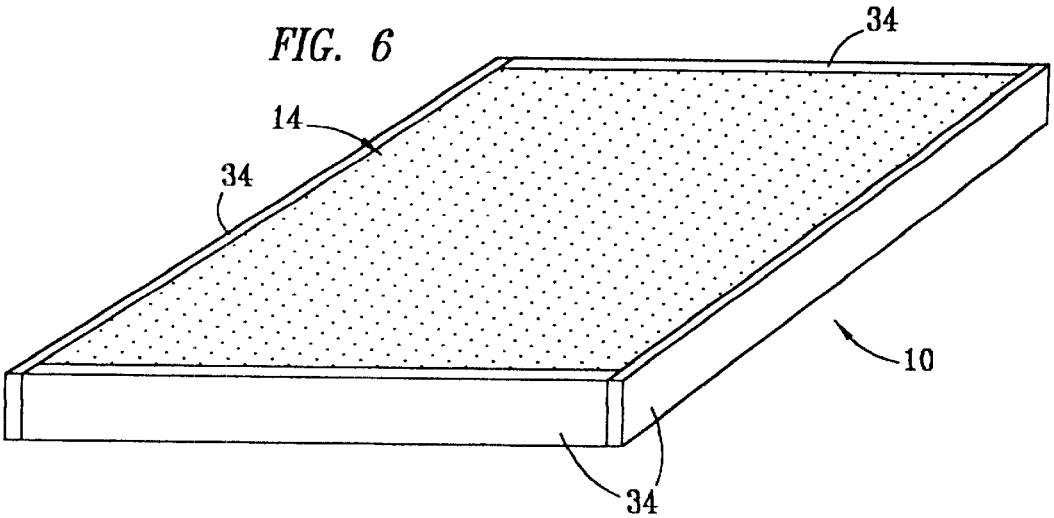
FIG. 6 shows a fabricated wall section according to the present invention.

The materials in FIG. 4 when assembled are shown in FIG. 5 as an embodiment of the invention, which is ready to receive the concrete. The wall section after pouring the concrete is shown in FIG. 6. It should be noted that the surface of panel 14 maybe left unfinished or it might be finished by sandblasting, with stucco, ornamental surfaces such as brick, stone or the like.

It should be noted that in the wall section as formed in FIG. 6 the concrete panel is fixed in place relative to the wall studs with insulation between the panel and the wall studs. Further the straps are insulated and do not conduct heat from the panel surface to the steel wall studs. Further, the entire assembly is contained in a relatively compact frame, which may be of wood or other readily formed, joined and disposable material. The frame materials may vary widely although wood is a preferred material for the frame.

The frame is readily moveable and if placed on a flat supporting surface with suitable supports beneath the supporting surface for use with a forklift and the like, the wall section can be moved to another area beyond the fabrication area for storage and curing. This permits much more efficient use of the existing work area for assembly of the wall sections.

Figure 7:
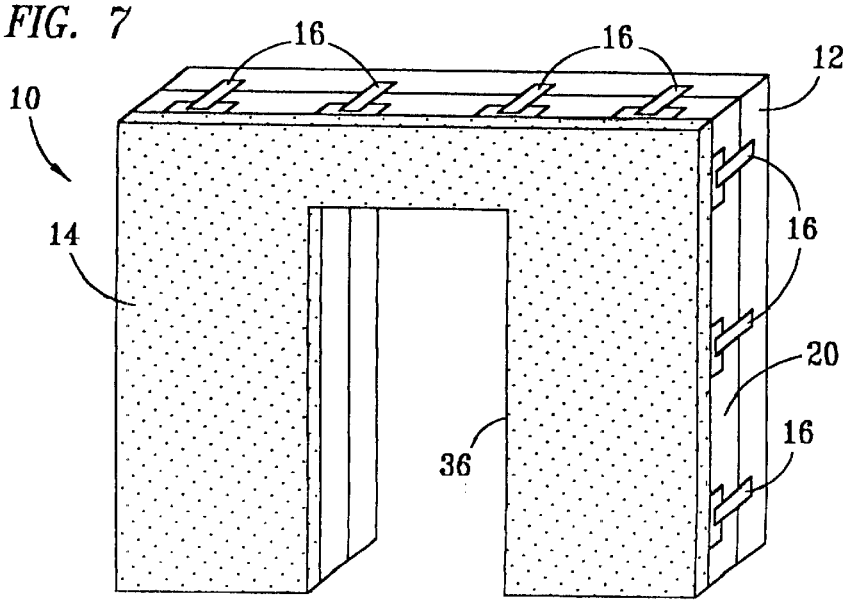
FIG. 7 shows a fabricated wall section according to the present invention wherein the wall section has been fabricated to include a door.

In FIG. 7 an embodiment is shown wherein a doorway 36 has been fabricated in a wall section.

Figure 8:
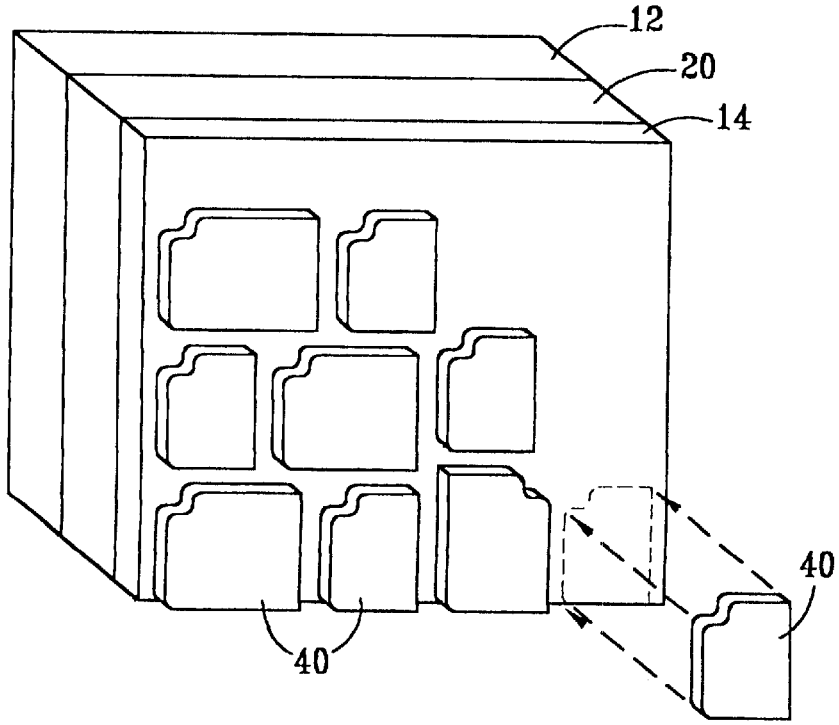
FIG. 8 shows a section according to the present invention, including an ornamental or protective finish applied to the outside of the concrete panel.

In FIG. 8 a decorative coating 40, shown as ornamental decorative sections, is shown in position on the surface of panel 14.

By the method of the present invention, the wall sections are readily assembled efficiently and in such a fashion that they can be removed to another area for curing, storage and the like. Further the wall sections include insulation between the back surface of the concrete panel and the steel wall studs and there is no uninsulated thermal connection between the steel wall studs and the panels. This permits the construction of wall sections having a much better insulation value. R-values as high as about 24 may be achieved for wall sections produced according to the present invention. Preferably the wall sections have an R-value of at least about 15. Not only are the wall sections of the present invention more amenable to use in the construction of a residential dwelling, but they also can be produced at a much lower cost because of the use of prefabricated materials and because of the more efficient method provided for the assembly and production of such panels.

According to the prior art, the panels were formed in re-usable permanent molds and allowed to cure before moving with the steel wall stud frame then being placed on the back of the panel after curing and adhered to the panel by a bonding pad formed by a "blob" of wet cement about an end of a connecting fastener and stuck to the back of the panel. This required a substantial waiting period for the panels to set, followed by an extended period for the bonding pad to set. The product wall sections did not provide good insulating value.

Wall sections produced according to the present invention do not suffer many of the disadvantages of the previously available wall sections of this type. For instance, steel wall panel studs in wall sections of the present invention will not sweat since they do not cool to the temperature of the outside of the panel. Further as noted, these wall sections provide very good insulating values and are readily used to fabricate houses and the like and do not require expensive permanent molds.

Figure 9:
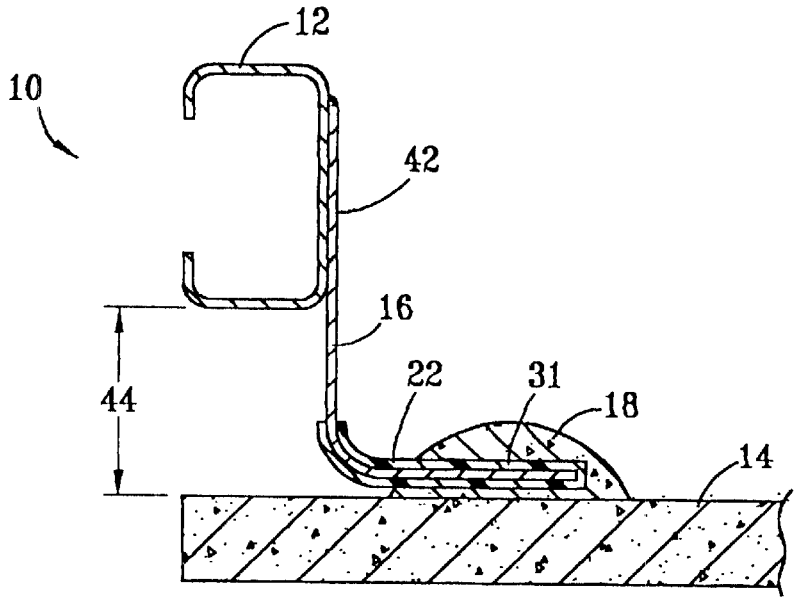
FIG. 9 shows an embodiment of an insulated fastener positioned to connect a panel and a steel wall stud.

An alternate embodiment of the present invention as shown in FIG. 9. A panel 14 is shown which can be formed by conventional techniques. The panel, once produced, is positioned relative to a wall section frame as shown by studs 12. The connection between the panel and the studs is made by a fastener 16 which has an end joined to stud 12 with its second insulated end 31 being coated with insulation 22 and positioned in a bonding pad 18. This wall section can be formed by conventional techniques except that insulation is positioned around the fastener which extends into the bonding pad or in the bonding pad as a receptacle for the fasteners. Typically, in the bonding pad the fastener is positioned to extend about 3 to 5 inches into the bonding pad and be about 0.25 to about 0.50 inches below the surface of the bonding pad. Desirably, the fastener is about 0.50 inch from the back surface of the panel.

Panels produced by this method have a high R-value since the spacing 44 between the steel frame as shown by stud 12 and the back of panel 14 is an effective insulator and since the fastener is insulated in the area in which it is in contact with the panel.

Figure 10:
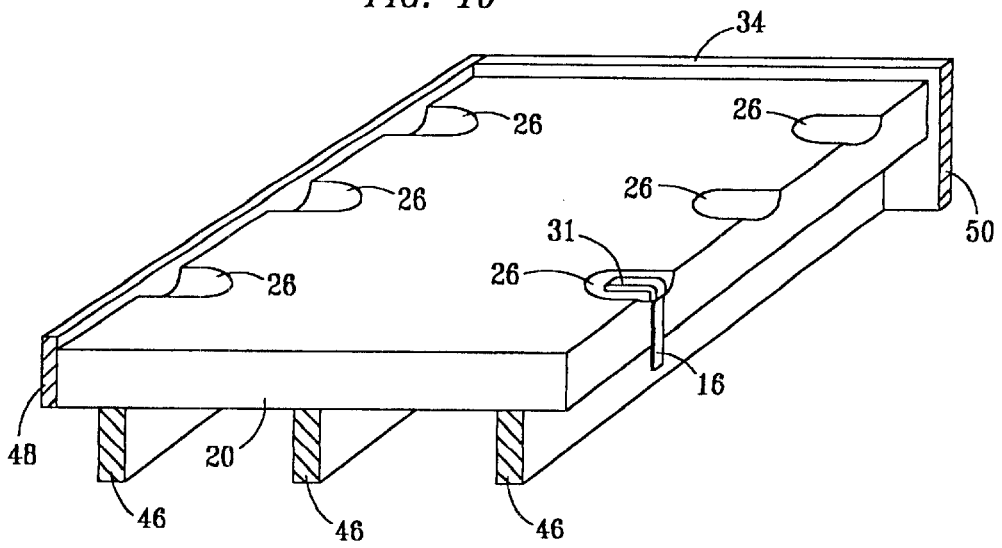
FIG. 10 is an isometric view of a formed insulation material in a partial frame for the production of an insulated panel; and, FIG. 11 is a cross-sectional view of a wall section produced using a panel produced as shown in FIG. 10.

In FIG. 10, a view of a system for producing an insulated panel is shown. Preformed insulation 20 is positioned on supports 46. Preformed insulation 20 can be of one or a plurality of sections and can have cavities 26 positioned as shown or at additional locations such as along a middle section for a middle stud. Cavities 26 are positioned to contain insulated fastener ends 31 as shown. While only a single insulated end of a fastener 16 is shown, it will be understood that a fastener of this type can be positioned in each of the cavities 26 or additional cavities if desired.

In the embodiment shown, straps are used as fasteners. Other fastener configurations could be used but as indicated previously, straps are preferred. These straps extend around the outside of formed insulation 20 and past the bottom surface of insulation 20 as shown. The extension beyond the bottom surface of formed insulation 20 is sufficient to permit connection of the formed insulation 20 to a wall section frame as discussed previously. A restraining frame 34 is positioned around formed insulation 20. Restraining frame 34 may be of a depth shown at 50 with the bottom end of the frame being substantially even with the bottom of supports 46, or the frame may have a depth shown at end 48 which extends only to the bottom of formed insulation 20. The frame 34 extends around formed insulation 20 so that the panel is formed by pouring glass reinforced concrete into the frame to fill cavities 26 thereby positioning ends 31 of straps 16 in position. The insulated panel so formed can readily be moved to storage in an area away from the fabrication zone and is readily joined to steel wall section frames as discussed above to produce GFRC/steel stud wall sections.

Figure 11:
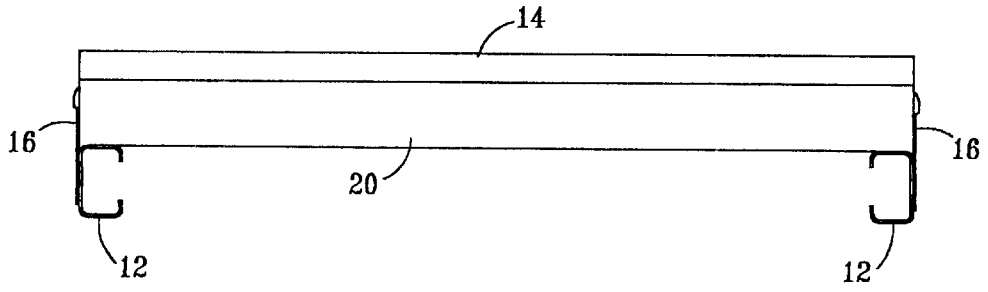

In FIG. 11, a cross-sectional view of a wall section produced by joining a panel produced by the apparatus and method used in FIG. 10 is shown connected to studs 12. The wall section comprises a panel 14 which is positioned by straps 16 in position relative to formed insulation 20 by connection to steel studs 12. The use of these panels permits the transportation of the insulated panels to a construction site prior to connecting them to the steel wall section frames. This may be advantageous in some instances.

Wall sections produced according to the embodiments of FIGS. 10 and 11 have the same advantages associated with the wall sections fabricated as discussed previously.

Having thus described the invention by reference to its preferred embodiments, it is pointed out the embodiments described are illustrative rather than limiting in nature and that many variations and modifications are possible within the scope of the present invention.

I claim:

1. An insulated glass fiber reinforced concrete/steel wall section comprising:

a) a wall section frame comprising at least two steel wall studs, and at least two steel end plates;

b) a glass fiber reinforced concrete panel having a front side facing away from the wall section frame and a back side facing toward the wall section frame and having a plurality of bonding pads on the back side;

c) a plurality of straps each having a first and a second end, the first ends being insulated and having an insulating coating over the first ends positioned in the bonding pads with the second ends being connected to the wall section frame; and, d) insulation positioned between the backside of the glass fiber reinforced panel and the wall section frame.

2. The wall section of claim 1 wherein the section comprises further intermediate wall studs positioned between the end plates and parallel to the at least two steel wall studs.

3. The wall section of claim 1 wherein the end plates are joined to the wall studs by at least one of welding, riveting, crimping, screws and bolts.

4. The wall section of claim 1 wherein the end plates are joined to the wall studs by crimping.

5. The wall section of claim 1 wherein the panel has a thickness of at least about 0.5 to about 12 inches.

6. The wall section of claim 1 wherein the bonding pads are formed as an integral part of the panel.

7. The wall section of claim 1 wherein the steel studs have a thickness from about 0.020 to about 0.90 inches.

8. The wall section of claim 1 wherein the straps are connected to the wall studs by at least one of welding, riveting, crimping, screws and bolts.

9. The wall section of claim 1 wherein the straps are connected to the wall studs by crimping.

10. The wall section of claim 1 wherein the wall section has an R-rating of at least about 15.

11. The wall section of claim 1 wherein the straps are bent so that the first ends of the straps are orthogonal to the second ends of the straps.

12. The wall section of claim 1 wherein the insulating coating on the first end of the straps is a plastic.

13. The wall section of claim 1 wherein the straps have a width from about 1.0 to about 1.5 inches.

14. The wall section of claim 1 wherein the straps have a thickness from about 0.020 to about 0.250 inches.

15. A method for producing an insulated glass fiber reinforced concrete panel for use in producing a glass fiber reinforced concrete/steel wall section by;

a) positioning a frame about and extending above a formed insulation member having a plurality of cavities in its upper surface;

b) positioning a plurality of fasteners each of the fasteners having a first fastener end and a second fastener end so that a portion of each second fastener end positioned in a cavity coating each second fastener end with an insulated coating and, c) filling the frame above the formed insulation member with fluid glass fiber reinforced concrete to form a glass fiber reinforced concrete panel above the formed insulation member.

16. A method for producing an insulated glass fiber reinforced concrete/steel wall section, the method comprising:

a) producing a steel wall section frame by joining at least two steel wall studs to a top and a bottom plate to form the steel wall section frame;

b) positioning a restraining frame about the steel wall section frame;

c) positioning a formed insulation having a plurality of cavities above the steel wall section frame, each of the cavities having a bottom above the steel wall section and inside the restraining frame, d) positioning a plurality of straps each having a first end, and a second end, the second ends having insulation over the second end with their first ends being connected to the wall studs and with their second ends having an insulating coating over the second ends positioned in the cavities with a selected space between the second ends and the bottoms of the cavities; and, e) filling the cavities and the restraining form to a selected level with fluid glass fiber reinforced concrete to form a glass fiber reinforced concrete panel.

17. The method of claim 16 wherein the wall section frame includes positioning at least one intermediate steel wall stud connected to the top and bottom plate and parallel to at least two steel wall studs.

18. The method of claim 16 wherein the retaining frame is a wooden frame.

19. The method of claim 16 wherein the straps are coated with insulation by dipping the second ends of the straps into an insulating plastic material to coat the second ends.

20. The method of claim 16 wherein the cavities are formed to produce bonding pads containing the second ends of the straps and are formed as a part of the glass fiber reinforced panels.

21. An insulated glass fiber reinforced concrete/steel wall section comprising;

a) a wall section frame comprising at least two steel wall studs and at least two steel end plates;

b) a glass fiber reinforced concrete panel having a front side facing away from the wall studs and a back side facing the wall studs and having a plurality of bonding pads on the back side; and, c) a plurality of fasteners, the fasteners having a first fastener end and a second fastener end, the first fastener ends being insulated and positioned in the bonding pads and having an insulating coating over the first fastener ends positioned in the bonding pads and the second ends of the fasteners being connected to the wall section frame to support the panel in spaced relationship to the wall section frame with a space between the panel and the wall section frame.

22. The wall section of claim 21 wherein the space is about 0.5 inches.

23. The wall section of claim 21 wherein the fasteners are rods having a diameter from about 0.375 to about 0.50 inches.

24. The wall section of claim 23 wherein the wall studs have a thickness of at least about 0.060 inches.

25. The wall section of claim 24 wherein the second ends of the rods are welded to the wall studs.

26. The wall section of claim 21 wherein the fasteners are straps having a width from about 1.0 to a bout 1.5 inches.

27. The wall section of claim 26 wherein the straps have a thickness from about 0.020 to about 0.250 inches.

28. The wall section of claim 27 wherein the wall studs have a thickness from about 0.020 to about 0.090 inches.

29. The wall section of claim 21 wherein the bonding pads are formed by positioning the first fastener ends at a parallel spaced apart position relative to the back side of the panel and positioning a quantity of glass fiber reinforced cement over the first fastener ends and in bonding contact with the back sides of the panels.

30. A method for fabricating an insulated glass fiber reinforced concrete/steel wall section by;

a) producing a steel wall section frame by joining at least two steel wall studs to a top and a bottom plate to form the steel wall section frame;

b) connecting a plurality of fasteners, the fasteners having a first and a second end, to support the steel wall section frame in spaced relationship to a glass fiber reinforced panel by embedding the first ends of the fasteners in supporting contact with the panel by positioning the first ends of the fasteners in bonding pads on a back surface of the panels and positioning the second ends of the fasteners in supporting contact with the wall frame; and, c) coating the portions of the first ends embedded in the bonding pads with an insulating coating prior to embedding the portions of the first ends in the bonding pads.

31. The method of claim 30 wherein the panel is spaced about 0.50 inches from the wall section.

32. The method of claim 31 wherein the fasteners are straps.

33. An insulated glass fiber reinforced concrete panel for use in producing a glass fiber reinforced concrete/steel wall section, the panel comprising a glass fiber reinforced concrete panel having a first and a second side and a plurality of formed bonding pads on its first side; a formed insulation member having a first and a second side and a plurality of cavities containing the formed bonding pads on its first side; and a plurality of fasteners each having a first fastener end and a second fastener end, the first fastener ends being ends positioned in a formed pad with the second of the fasteners extending from a formed pad past or through the second side of the formed insulation, the second ends of the fasteners having an insulated coating thereon.

* * * * *